US005270615A

United States Patent [19]

Chang

[11] Patent Number: 5,270,615

[45] Date of Patent: Dec. 14, 1993

[54] MULTI-LAYER OXIDE COATING FOR HIGH INTENSITY METAL HALIDE DISCHARGE LAMPS

[75] Inventor: Hsueh-Rong Chang, Scotia, N.Y.

[73] Assignee: General Electric Company, Schenectady, N.Y.

[21] Appl. No.: 796,292

[22] Filed: Nov. 22, 1991

[51] Int. Cl.[5] ..... H01J 61/35; H01J 61/18

[52] U.S. Cl. ..... 313/635; 313/638; 313/489

[58] Field of Search ..... 313/635, 638, 489, 161, 313/490, 562, 479, 481; 315/248

[56] References Cited

U.S. PATENT DOCUMENTS

| | | | |
|---|---|---|---|
| 3,350,598 | 10/1967 | Corbin et al. | 313/635 |
| 3,377,498 | 4/1968 | Koury et al. | 313/635 |
| 4,810,938 | 3/1989 | Johnson et al. | 315/248 |
| 4,812,702 | 3/1989 | Anderson | 313/153 |
| 4,972,120 | 11/1990 | Witting | 313/638 |
| 5,032,757 | 7/1991 | Witting | 313/635 X |
| 5,032,762 | 7/1991 | Spacil et al. | 313/635 |
| 5,039,903 | 8/1991 | Farrall | 313/160 |
| 5,057,751 | 10/1991 | Witting et al. | 313/635 X |

*Primary Examiner*—Donald J. Yusko
*Assistant Examiner*—Ashok Patel
*Attorney, Agent, or Firm*—Jill M. Breedlove; Marvin Snyder

[57] ABSTRACT

A coating for the arc tube of a high intensity metal halide discharge lamp includes at least two oxide layers for protecting the arc tube from devitrification, cracking and etching of the arc tube wall and for avoiding arc instability, thereby extending the useful life of the lamp. A first layer of the multi-layer oxide coating is applied directly to the arc tube to provide thermal compatibility in order to avoid cracking during lamp operation. At least one additional layer provides chemical stability of the arc tube wall with respect to the lamp fill. As a result, a substantial loss of the metal portion of the fill and a corresponding substantial buildup of free halogen are avoided, thereby avoiding devitrification and etching of the arc tube wall. Furthermore, for HID lamps including as a fill ingredient a metal, such as sodium, which diffuses into the arc tube wall and causes further devitrification thereof, at least one layer of the multi-layer oxide coating acts as metal-barrier.

4 Claims, 1 Drawing Sheet

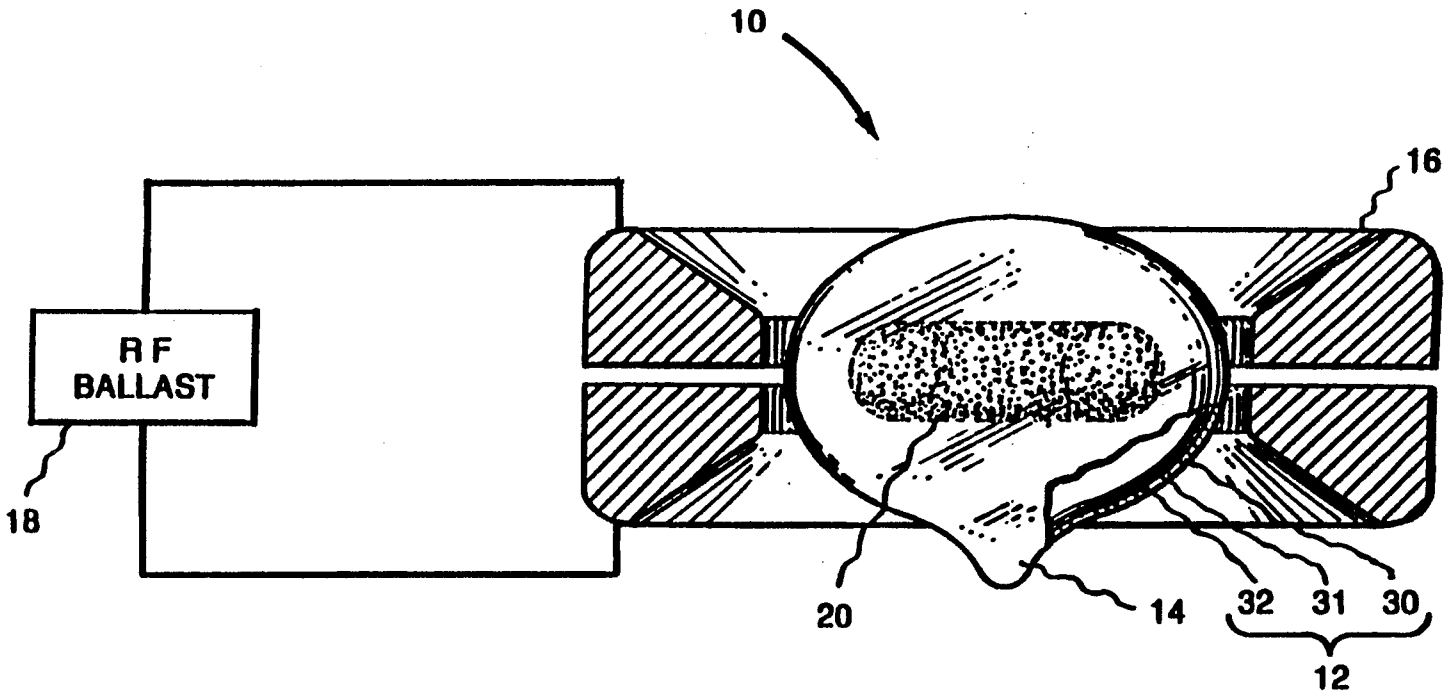
10
16
12
30
31
32
14
20
RF
BALLAST
18

MULTI-LAYER OXIDE COATING FOR HIGH INTENSITY METAL HALIDE DISCHARGE LAMPS

FIELD OF THE INVENTION

The present invention relates generally to high intensity metal halide discharge lamps. More particularly, the present invention relates to a multi-layer oxide coating for protecting the arc tube of a metal halide discharge lamp and thereby improving the performance and extending the useful life thereof.

BACKGROUND OF THE INVENTION

In operation of a high-intensity metal halide discharge lamp, visible radiation is emitted by the metal portion of the metal halide fill at relatively high pressure upon excitation typically caused by passage of current therethrough. One class of high-intensity, metal halide lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary RF current in the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High-intensity, metal halide discharge lamps, such as the aforementioned electrodeless lamps, generally provide good color rendition and high efficacy in accordance with the principles of general purpose illumination. However, the lifetime of such lamps can be limited by the loss of the metal portion of the metal halide fill during lamp operation and the corresponding buildup of free halogen. In particular, during lamp operation, the metal halide fill is dissociated by the arc discharge into positive metal ions and negative halide ions. The positive metal ions are driven toward the arc tube wall by the electric field of the arc discharge. Metal which does not react with halide ions before reaching the arc tube wall may react chemically at the wall. For example, in an arc tube containing a fill including sodium iodide and cerium iodide, sodium reacts with the quartz arc tube to form sodium silicate crystals, causing devitrification of the arc tube. Moreover, the dose of sodium and cerium iodides catalyzes the crystal nucleation of fused silica, enhancing the devitrification process. The thermal mismatch between the newly formed crystalline silica and the amorphous silica of the arc tube causes severe cracking of the arc tube wall. As another problem, cerium causes chemical etching of the arc tube wall, leading to rough and uneven inner wall surfaces. Furthermore, the loss of the metal atoms through the devitrification and etching processes leads to the release of free halogen into the arc tube, causing arc instability and eventual arc extinction, especially in electrodeless high-intensity, metal halide discharge lamps.

Therefore, it is desirable to provide a new and improved coating for a high intensity metal halide discharge lamp that provides both chemical and thermal stability, as well as thermal compatibility with the arc tube, thereby substantially extending the useful life of the lamp.

SUMMARY OF THE INVENTION

An improved coating for a fused silica arc tube of a high intensity metal halide discharge lamp comprises at least two oxide layers for protecting the arc tube from devitrification, cracking and etching of the arc tube wall and for avoiding arc instability, thereby extending the useful life of the lamp. A first oxide layer, which has a thermal expansion coefficient comparable to that of the fused silica arc tube (i.e., $2.19\times10^{-6}/\cdot\kappa$), is applied directly to the inner surface of the arc tube to provide thermal compatibility and thus prevent cracking of the arc tube wall and spalling of the arc tube coating during lamp operation. At least one additional layer of the multi-layer oxide coating provides chemical and thermal stability of the arc tube wall with respect to the lamp fill. As a result, a substantial loss of the metal portion of the fill and a corresponding substantial buildup of free halogen are avoided, thereby avoiding devitrification and etching of the arc tube wall. In addition, for HID lamps including as a fill ingredient a metal, such as sodium, which diffuses into the arc tube and causes further devitrification thereof, at least one layer of the multi-layer oxide coating acts as metal-barrier.

In one embodiment, an HID lamp having a fill including sodium iodide and cerium iodide has a first oxide layer of tantalum oxide ($Ta_2O_5$) applied directly to the arc tube to provide thermal compatibility. A second oxide layer is comprised of, for example, scandium oxide ($Sc_2O_3$), yttrium oxide ($Y_2O_3$) or aluminum oxide ($Al_2O_3$), to provide chemical stability and also to act as a sodium barrier.

BRIEF DESCRIPTION OF THE DRAWINGS

The features and advantages of the present invention will become apparent from the following detailed description of the invention when read with the sole accompanying drawing illustrates a high-intensity, metal halide discharge lamp employing a multi-layer oxide coating in accordance with the present invention.

DETAILED DESCRIPTION OF THE INVENTION

The sole drawing FIGURE illustrates a high-intensity, metal halide discharge lamp 10 employing a multi-layer oxide coating 12 in accordance with the present invention. For purposes of illustration, lamp 10 is shown as an electrodeless, high-intensity, metal halide discharge lamp. However, it is to be understood that the principles of the present invention apply equally well to high-intensity, metal halide discharge lamps having electrodes. As shown, electrodeless metal halide discharge lamp 10 includes an arc tube 14 formed of a high temperature glass, such as fused silica. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a metal halide fill in which a solenoidal arc discharge is excited during lamp operation. A suitable fill, described in commonly assigned U.S. Pat. No. 4,810,938 of P.D. Johnson, J.T. Dakin and J.M. Anderson, issued on Mar. 7, 1989, comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. The Johnson et al. patent is incorporated by reference herein. Another suitable fill is described in commonly assigned U.S. Pat. No. 4,972,120 of H.L. Witting, issued Nov. 20, 1990, which patent is incorporated by reference herein. The fill of the Witting patent comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon.

Electrical power is applied to the HID lamp by an excitation coil 16 disposed about arc tube 14 which is driven by an RF signal via a ballast 18. A suitable excitation coil 16 may comprise, for example, a two-turn coil having a configuration such as that described in commonly assigned U.S. Pat. No. 5,039,903 of G.A. Farrall, issued Aug. 13, 1991, which patent is incorporated by reference herein. Such a coil configuration results in very high efficiency and causes only minimal blockage of light from the lamp. The overall shape of the excitation coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J.M. Anderson, issued Mar. 14, 1989, which patent is incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

In accordance with the present invention, coating 12 comprises a plurality of oxide layers to perform the functions of: providing a thermally stable arc tube which will not crack during lamp operation or other prolonged exposure to heat; and providing chemical stability between the fill and the arc tube so as to avoid devitrification and/or etching of the arc tube as a result of a substantial loss of the metal portion of the fill and a corresponding substantial buildup of free halogen. In addition, for HID lamps including as a fill ingredient a metal, such as sodium, which diffuses into the arc tube and causes further devitrification thereof, at least one layer of the multi-layer oxide coating acts as metal-barrier.

By way of example, coating 12 is shown as comprising three oxide layers 30, 31 and 32 applied to the inner surface of an arc tube having sodium iodide (NaI) and cerium iodide ($CeI_3$) as fill ingredients. A suitable layer 30 comprises, for example, tantalum oxide ($Ta_2O_5$), having a thermal expansion coefficient of $3.48\times10^{6}/\cdot K$, to provide thermal compatibility with the quartz arc tube. Other suitable oxide layers 30 for providing thermal compatibility have thermal expansion coefficients in the range from approximately $1\times10^{-6}$ to approximately $4\times10^{-6}/\cdot K$, a suitable oxide being niobium oxide ($Nb_2O_5$). Layers 30, 31 and 32 may be applied to arc tube 14 using a chemical vapor deposition process.

A suitable layer 31 is comprised of hafnium oxide ($HfO_2$) for acting as a sodium barrier to avoid sodium diffusion into the arc tube, thereby avoiding devitrication of the arc tube due to the formation of sodium silicates. Other suitable sodium barrier oxides include yttrium oxide ($Y_2O_3$), aluminum oxide ($Al_2O_3$) and scandium oxide ($Sc_2O_3$). As a result of avoiding sodium loss through diffusion, iodine pressure remains sufficiently low to maintain arc stability.

A suitable layer 32 for providing chemical and thermal stability comprises, for example, yttrium oxide ($Y_2O_3$) or scandium oxide ($Sc_2O_3$), which acts to suppress cerium oxidation and hence cerium loss; etching of the arc tube by cerium is thus avoided. However, if, for example, yttrium oxide is employed in the multilayer oxide coating of the present invention, then only two layers 30 and 31 are needed because yttrium oxide provides both chemical stability and acts as a sodium barrier. Yet, even though only two layers are needed, it may be desirable for a particular application to use three or more oxide layers in order to provide additional thermal compatibility. In particular, by employing more layers, the thermal expansion coefficient gradient between adjacent layers can be made smaller, resulting in even greater thermal compatibility. In general, however, it is to be understood that the layers of the multilayer oxide coating of the present invention may comprise any suitable combination of the aforementioned oxides to perform the functions of the coating described hereinabove.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A high intensity discharge lamp, comprising:

a light-transmissive arc tube for containing a plasma arc discharge, said arc tube comprising fused silica;

a fill disposed in said arc tube, said fill including at least one metal halide;

excitation means for coupling electrical power to said fill for exciting said arc discharge therein; and a multi-layer oxide coating disposed on the inner surface of said arc tube, a first layer of said coating applied directly to the inner surface of said arc tube and having a thermal expansion coefficient compatible with said arc tube in order to avoid cracking thereof, said first layer of said coating comprising an oxide having a thermal expansion coefficient in the range from approximately $1\times10^{-6}/\cdot K$ to approximately $4\times10^{-6}/\cdot K$, said coating further including at least one additional layer for providing chemical stability between said fill and said arc tube in order to avoid devitrification and etching of said arc tube.

2. A high intensity discharge lamp, comprising:

a light-transmissive arc tube for containing a plasma arc discharge, said arc tube comprising fused silica;

a fill disposed in said arc tube, said fill including at least one metal halide;

excitation means for coupling electrical power to said fill for exciting said arc discharge therein; and a multi-layer oxide coating disposed on the inner surface of said arc tube, a first layer of said coating applied directly to the inner surface of said arc tube and having a thermal expansion coefficient compatible with said arc tube in order to avoid cracking thereof, said first layer of said coating comprising an oxide having a thermal expansion coefficient in the range from approximately $1\times10^{-6}/\cdot K$ to approximately $4\times10^{-6}/\cdot K$, said first layer of said coating comprising an oxide selected from the group consisting of tantalum oxide and niobium oxide, said coating further including at least one additional layer for providing chemical stability between said fill and said arc tube in order to avoid devitrification and etching of said arc tube.

3. A high intensity discharge lamp, comprising:

a light-transmissive arc tube for containing a plasma arc discharge, said arc tube comprising fused silica;

a fill disposed in said arc tube, said fill including at least one metal halide;

excitation means for coupling electrical power to said fill for exciting said arc discharge therein; and a multi-layer oxide coating disposed on the inner surface of said arc tube, a first layer of said coating applied directly to the inner surface of said arc tube and having a thermal expansion coefficient compatible with said arc tube in order to avoid cracking thereof, said coating further including at least one additional layer for providing chemical stability between said fill and said arc tube in order to avoid devitrification and etching of said arc tube;

said fill including a sodium halide at least one of said layers of said multi-layer oxide coating acting as a sodium barrier to avoid sodium diffusion into the wall of said arc tube.

4. The lamp of claim 3 wherein the sodium barrier layer comprises an oxide selected from the group consisting of hafnium oxide, yttrium oxide, aluminum oxide, and scandium oxide.

* * * * *